United States Patent [19]

Ullum

[11] Patent Number: 4,711,041

[45] Date of Patent: Dec. 8, 1987

[54] ROTARY DRIER WITH LIFTING ELEMENT

[75] Inventor: Henrik Ullum, Karlslunde, Denmark

[73] Assignee: A/S Atlas, Ballerup, Denmark

[21] Appl. No.: 876,883

[22] PCT Filed: Oct. 2, 1985

[86] PCT No.: PCT/DK85/00091

§ 371 Date: Jun. 20, 1986

§ 102(e) Date: Jun. 20, 1986

[87] PCT Pub. No.: WO86/02150

PCT Pub. Date: Apr. 10, 1986

[30] Foreign Application Priority Data

Oct. 4, 1984 [DK] Denmark ..... 4753/84

[51] Int. Cl.[4] ..... F26B 11/04

[52] U.S. Cl. ..... 34/179; 34/182; 34/183; 165/92

[58] Field of Search ..... 34/182, 183, 179; 165/92

[56] References Cited

U.S. PATENT DOCUMENTS 3,701,713 10/1972 Bennett et al. ..... 34/182
3,777,810 12/1973 Phillips ..... 34/183

FOREIGN PATENT DOCUMENTS 125494 2/1973 Denmark .
138406 8/1978 Denmark .
323462 7/1920 Fed. Rep. of Germany .
130800 2/1951 Sweden .

*Primary Examiner*—Larry I. Schwartz
*Attorney, Agent, or Firm*—Merchant, Gould, Smith, Edell, Welter & Schmidt

[57] ABSTRACT

A drier for the heating and drying of wet, comminuted organic materials comprises a stationary housing with a revolving, hollow axle or rotor (1) with inlet and outlet for a heating medium, and where the rotor has a number of annular drying elements (2) disposed at intervals. The drying elements (2) are heated by the heating medium through heat channels (3). On or between the drying elements, lifting elements (4) are disposed along the circumference. Adjacent lifting elements are disposed in a displaced manner from each other to the same side along the outer periphery of the annular elements (2), so that the leading edges (11) extend along a helical line. The drier hereby provides an improved drying and mixing and has a better efficiency. Furthermore, one can determine how quickly the material being dried shall travel forwards, or how long it shall remain in a certain zone. The invention also relates to a lifting element for the drier.

7 Claims, 3 Drawing Figures

1

2

ROTARY DRIER WITH LIFTING ELEMENT

BACKGROUND OF THE INVENTION

The invention relates to a drier of wet comminuted materials such as organic matter.

Such driers are known, for example from Danish Pat. No. 138.406, where the drier's rotor is provided with helical cavities in the annular drying elements, which on the surface have completely smooth faces in contact with the material to be dried, so that it is difficult for said material to stick fast and reduce the efficiency of the drier. However, stationary clearing elements can be arranged to reach in between the drying elements, for example in the zone where the material to be dried is still very adhesive. Moreover, transverse or obliquely-positioned vanes can be disposed on the rotating drying elements themselves, which help to move the material being dried forward towards the discharge opening for the dried product. Driers of this kind are used for the drying of fishmeal, comminuted offal, mash and similar products, and are often designed for high performance, e.g. for the drying of 1 to 4 tons per hour.

SUMMARY OF THE INVENTION

The object of the invention is to improve driers of this kind, so that an improved drying and mixing during the drying is achieved, whereby the efficiency of the drier is increased.

This is achieved by constructing the drier according to the invention. The lifting elements lift the material being dried in portions, and tear any possible lumps into pieces. The lifted material falls down over the drying rotor, and is thus given more frequent contact with the heating surfaces. At the same time, a better stirring is thus achieved, so that the material being dried is mixed more thoroughly, the result being a completely uniform product.

The lifting elements will sit in a particularly secure manner, in that the lifting elements can be fastened on two sides.

By way of example, the drier may be constructed so that it provides further possibilities of achieving a solid mounting and securing of the lifting elements.

The drier according to the invention can be constructed so that the lifted material is spread a lot during its fall down over the rotor, and thus comes into contact with the whole of the heating surface, while at the same time a great mixing effect is achieved.

It is also possible in a simple manner to secure the lifting elements with bolts and to replace them, for example if they are worn or defect, but one can also adapt the drier for another production where another number of lifting elements provide an optimum operation.

One can also determine now quickly the material being dried shall travel forwards in the drier and, if there is a need for this, the lifting elements can be disposed in such a manner that the material being dried remains longer in one zone than in another. A further possibility is thus achieved of being able to set the drier precisely for the raw materials to be dired. The consumption of energy is hereby optimized, so that the drier according to the invention uses the least possible thermal energy for the process without any adverse affect on the speed of production.

The lifting element achieved hereby is robust but still inexpensive, and can be produced in a simple manner from plate material with sufficient strength and wear characteristics. An extremely simple construction is also acheivable which can be stamped out in one operation, e.g. so that the completely finished lifting element is complete with securing holes. Furthermore, if the plate piece is formed symmetrically and securing holes are provided in two free edges in both triangular portions, the lifting element can be turned when the leading edge is worn, hereby further increasing its lifetime.

The drier according to the invention has proved to be particularly well-suited for use in the production of meat meal, bone meal and fish meal, and great improvements have been achieved hereby, both of a technical as well economic nature.

BRIEF DESCRIPTION OF THE DRAWINGS

The invention will now be described in closer detail with reference to the drawing, which shows a preferred embodiment of the drier according to the invention, and where.

DETAILED DESCRIPTION OF THE DRAWINGS

Figure 1:
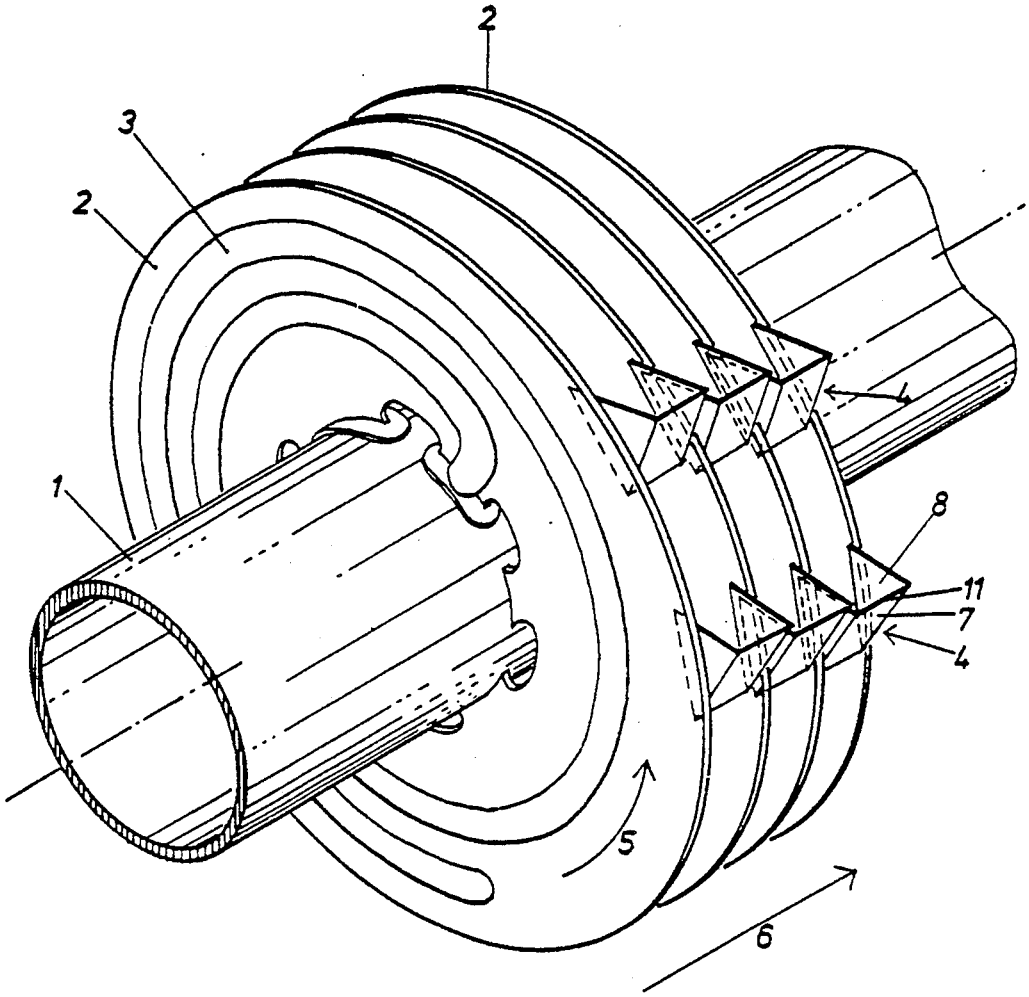
FIG. 1 is a perspective drawing of a part of a rotor with lifting elements, which at the same time transport the material to be dried forwards.
Figure 2:
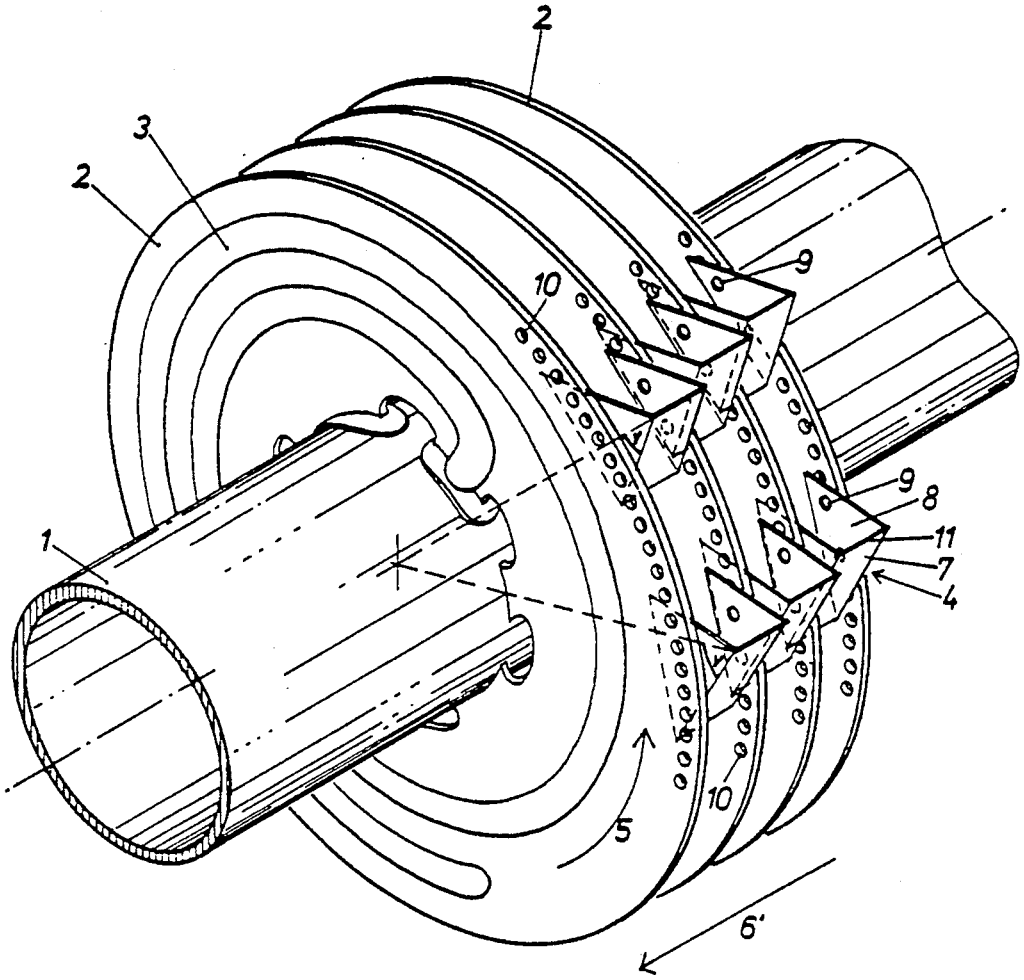
FIG. 2 shows the same as FIG. 1, but where the lifting elements are disposed in such a way that the material to be dried is moved in the opposite direction.

FIGS. 1 and 2 of the drawing show a hollow rotor axle 1 with a number of annular elements 2 in which there are helical heat channels 3, these being connected to a heat source, e.g. a steam generator, through pipes in the hollow axle 1. The axle 1 with the drying element 2 rotates as shown by the arrow 5. Around the rotor is disposed a not-shown stationary housing with filling opening, discharge opening, possibly a heat jacket and inspection hatch, cleaning hatch etc.

The arrow 6 in FIG. 1 shows the normal direction of transport through the drier from the filling opening to the discharge opening. On the drying elements 2, or more correctly between two consecutive drying elements 2, are disposed a number of lifting elements 4 with uniform distance around the circumference, for example eight lifting elements per intervening space. Each lifting element 4 consists of a support-plate part 7 and two triangular securing parts 8 which are fastened to the drying elements 2 by welding.

In FIG. 2, the lifting elements 4 are shown secured with bolts (not-shown) through holes 9 in the triangular parts 8 of the lifting elements and holes 10 around the edge of the annular elements.

The lifting elements 4 can be mounted as shown in FIG. 1, so that the individual lifting elements are parallel with the rotor axle, but where they are disposed slightly displace from each other so that their leading edges 11 follow a substantially helical line. The lifting elements 4 here contribute towards the transport of the material in the direction of the arrow 6.

By disposing the lifting elements 4 as shown in FIG. 2, where the helical line for the leading edges 11 of the lifting elements has a pitch which is opposite to that of FIG. 1, the lifting elements 4 will seek to transport the material in the direction of arrow 6, i.e. in the opposite direction to FIG. 1. However, if one continues to load material to be dried through the filling opening, the disposal of the lifting elements as shown in FIG. 2 will only slow down the transportation, the result being that the material being dried will remain for a longer time in that zone in which the lifting elements are disposed as shown in FIG. 2. One can hereby ensure that the material stays for a longer time in one zone than another zone in the drier.

The support-plate part 7 on the lifting element 4 has a rake in relation to the radial direction as shown by the angle V. This angle depends on the kind of material to be treated, but the angle V can also be different in different zones in the drier.

Figure 3:
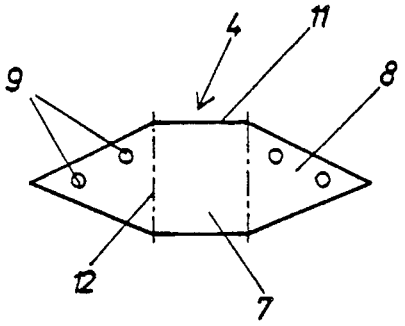
FIG. 3 shows a lifting element before the bending along the bending lines.

In FIG. 3 is shown a lifting element 4 in its unfolded state, i.e. after it has been stamped out or blanked from a plate of stainless steel, but before it has been bent along the bending lines 12 to form a lifting element. The lifting element consists of a rectangular or square support-plate part 7 and two triangular securing parts 8 which have the bending line common with the support-plate part. If the lifting element 4 is to be of the kind which can be bolted firmly to the annular elements, it is provided with holes 9 in the triangular securing parts. If additional holes are provided in the opposite sides of the triangular securing parts, the lifting element can be made symmetrical, thus providing two usable leading edges 11, so that one can turn the lifting element when the leading edge is worn.

Driers of the kind described rotate at about 7–12 revolutions per minute. Depending on the product to be dried, lifting elements are disposed in the zones where one can achieve the desired effect in the form of better stirring and better efficiency, because one achieves more frequent and thus better contact between the heating surfaces and the material being dried.

I claim:

1. Drier for the heating and drying of wet, comminuted materials, mainly organic materials, said drier comprising at least a stationary housing with a revolving, hollow rotor with an inlet and outlet for a heating medium, said rotor including a plurality of annular drying elements disposed at intervals therealong and which are heated by the heating medium, at least one lifting element located between and secured to two adjacent drying elements and spanning same, said lifting elements including at least a pair of securing members secured to and extending generally radially from said lifting element and a support portion bridging said securing members.

2. Drier according to claim 1, wherein said support portion is a substantially rectangular plate, the plane of which is parallel with the axis of the rotor, but which forms an angle V between 0° and 75°, with a plane through the rotor axis.

3. Drier according to claim 1, wherein the drying elements have a plurality of holes at regular intervals along their outer edges, and that said securing members include at least one hole, whereby said securing members can be adjustably affixed to said rotor.

4. Drier according to claim 1, wherein said lifting elements are permanently secured to the drying elements by welds.

5. Drier according to claim 1, wherein adjacent lifting elements are disposed in a displaced manner from each other, to the same side along the outer periphery of the drying elements so that the support elements extend along a substantially helical line.

6. A drier according to claim 1 wherein said lifting element is formed as a single, unitary piece having approximately 90° bends along two parallel bending lines.

7. A drier according to claim 6 wherein said lifting element includes a rectangular part and two identical, triangular securing elements with the one side of the triangle comprising the line of bending.

* * * * *